United States Patent [19]

Riordan

[11] Patent Number: 4,857,892

[45] Date of Patent: Aug. 15, 1989

[54] ART ALARM BACKING FOR PROTECTING A WORK OF ART

[76] Inventor: Dennis E. Riordan, 2326 Sawtelle Blvd., Los Angeles, Calif. 90049

[21] Appl. No.: 168,853

[22] Filed: Mar. 16, 1988

[51] Int. Cl.[4] ..... G08B 13/00; G08B 13/12

[52] U.S. Cl. ..... 340/568; 340/540; 340/550; 340/652

[58] Field of Search ..... 340/568, 652, 540, 550

[56] References Cited

U.S. PATENT DOCUMENTS

| | | | |
|---|---|---|---|
| 3,594,770 | 7/1971 | Ham et al. | 340/550 |
| 3,760,402 | 9/1973 | Magerle et al. | 340/568 |
| 4,146,293 | 3/1979 | Mutton et al. | 340/550 |
| 4,234,875 | 11/1980 | Williams | 340/652 |

*Primary Examiner*—Glen R. Swann, III

*Attorney, Agent, or Firm*—W. Edward Johansen

[57] ABSTRACT

A rectangular sheet of backing material has a first surface and a second surface and a conductive wire which is mechanically coupled to the first surface of the rectangular sheet of backing material. A work of art includes a decorative frame and a stretcher frame which has a first surface and a second surface and which has a rim disposed on its first surface along its peripheral edge and a painting canvas which has a front side and a back side. The stretcher frame includes a plurality of individual frame members which permit each of four peripheral edges of the front side of the painting canvas to be folded over so that the folded over peripheral edge is adjacent to the back side of the painting canvas. The dimensions of the stretcher frame may be expanded in order to stretch the painting canvas. The stretcher frame and the painting canvas are mounted on the decorative frame. A plurality of staples secure the conductive wire to the painting canvas, the stretcher frame and the decorative frame. The second surface of the rectangular sheet of backing material is disposed adjacent to the back side of the painting canvas. The conductive wire is electrically coupled to an alarm transmitter and a tamper switch which are disposed within the decorative frame.

3 Claims, 2 Drawing Sheets

Fig. 1.
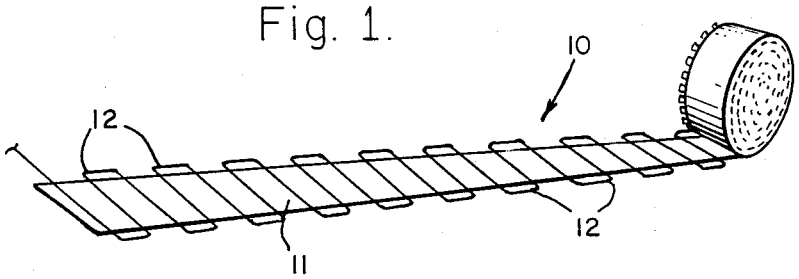
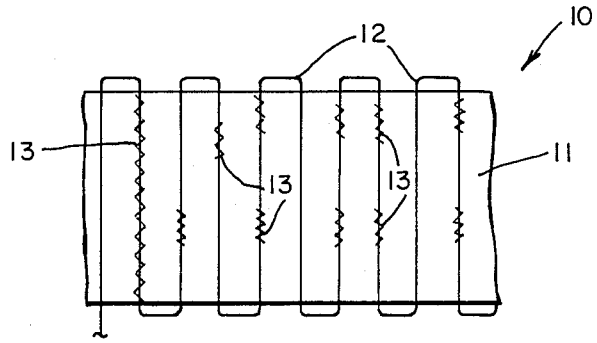
Fig. 2.
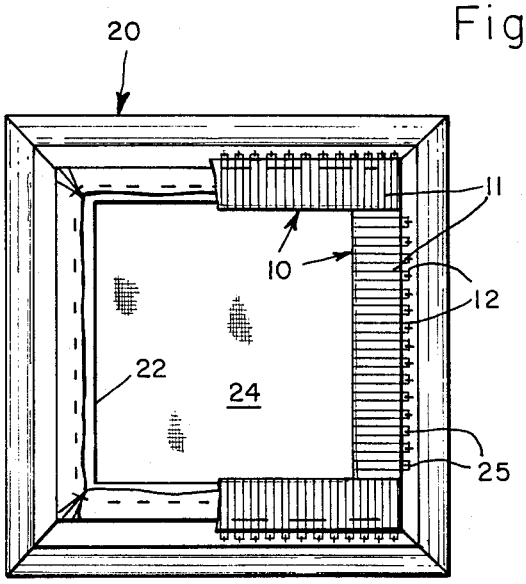
Fig. 3.
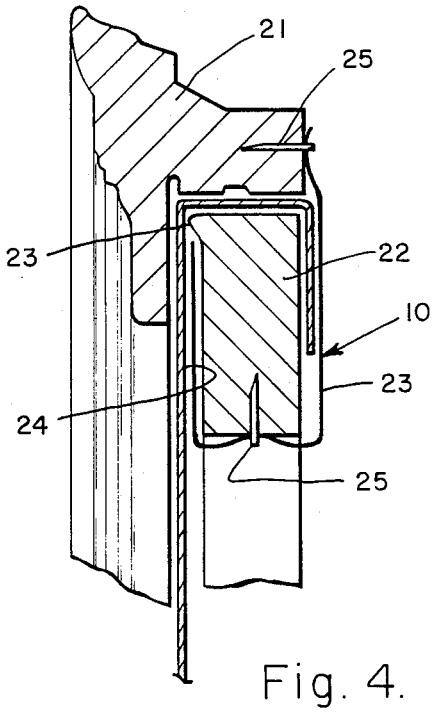
Fig. 4.

ART ALARM BACKING FOR PROTECTING A WORK OF ART

BACKGROUND OF THE INVENTION

1. Field of the Inventions

The present invention relates to an art alarm backing and more particularly to an art alarm backing which prevents either a front razor trim-out of either a painting or a tapestry or any slide-out of either its canvas or its canvas stretch frame and may also limit sabotage to only one painting or tapestry.

2. Description of the Prior Art

U.S. Pat. No. 4,458,241, entitled Device for Protecting Works of Art, issued to Henry E. Frankenberg on July 3, 1984, teaches an anti-theft device which has a pair of contact elements which are mountable on a picture frame. One of the elements is pendulously swingable with reference to the other so as to contact or break contact with the other element when the picture is disturbed thereby actuating a circuit which sets off an alarm. The anti-theft device is mounted on the backside of a painting canvas and includes a pair of intersectingly arranged contact elements which are disposed, in the mounted position of the painting, in selectively open (non-contacting) or closed (contacting) positions with respect to each other. An alarm device and a circuit are connected through the contact elements for setting off the alarm device. A first mechanism movably mounts at least one of the contact elements with respect to the other for movement from open to closed position to actuate the alarm circuit upon movement of the painting. A second mechanism inhibits touching of the canvas and includes a movement translator which is a means disposed on one of the contact elements in opposition to the backside of the canvas for movement thereby into circuit alarm operating position upon predetermined deflection of the canvas.

U.S. Pat. No. 4,391,203, entitled Security Apparatus, issued to Frederick W. Miller on July 5, 1983, teaches a security apparatus which is operable to protect by triggering an alarm a painting or similar artwork by formation of a vacuum chamber between the painting and a wall from which it is mounted. The vacuum chamber contains a battery operated alarm to be triggered on loss of vacuum within the chamber.

U.S. Pat. No. 3,612,469, entitled Theft-Proof Wall-Hung Mounting for Mirrors and the Like, issued to Harry F. Dennis on Oct. 10, 1971, teaches a wall-hung mirror frame which is adapted to be suspended from one or more frame engaging hangers. The rear of the frame is provided with a resilient locking bracket having an inturned flange selectively engageable with a series of louvers formed in a catch hanger affixed to the wall, the parts being positioned so that the locking bracket and catch hanger, when interengaged, will fixedly secure the frame so that it cannot be removed from the frame hangers.

U.S. Pat. No. 3,051,953, entitled protective Screen, issued to Clarence P. Willson on Aug. 28, 1962, teaches an alarm screen which includes a frame which is mounted on a building enclosing structure, a screen mesh which is formed from a sheet of non-conductive screen material and which has its marginal portion secured to the frame and at least two strands of conductive wire which are disposed parallel and spaced apart and which are interwoven in the screen mesh with each of the strands having an end portion which terminates adjacent to the frame. It is necessary to mechanically splice together, by either soldering or twisting to each other, the ends of the strands of conductive wire in order to form a continuous wire.

U.S. Pat. No. 4,146,293, entitled Entry Detection Screen, issued to Robert E. Mutton and Dennis E. Riordan on Mar. 27, 1979, teaches an alarm screen which includes a frame and a screen mesh. The alarm screen also includes a single wire which is sewn onto the screen mesh in order to fix it in place and which provide a series circuit.

U.S. Pat. No. 4,232,310, entitled Protective Window Screen Assembly, issued to Clarence P. Wilson on Nov. 4, 1980, teaches a screen assembly which includes rectangular screen mesh with several parallel security strands of insulated conductive wire extending between opposite sides of the screen mesh. Insulated cross wires lie on a face of the screen mesh near the opposite sides thereof, are joined by welding or soldering to points on the security strands, and are cut at selected locations to provide a sinuous electrical path through the screen mesh. A spline of insulative material extends around the border of the screen mesh and encapsulates the locations where the cross wire is joined to the security strands.

U.S. Pat. No. 4,307,386, entitled Security System and Stip or Strand Incorporating Fibre-Optic Wave Guide Means Therefor, issued to Richard F. Bridge on Dec. 22, 1981 and U.S. Pat. No. 4,275,294, entitled Security System and Stip or Strand Incorporating Fibre-Optic Wave Guide Means Therefor, issued to Roderick I. Davidson on June 23, 1981, teach a fiber optical wave guide which is positioned against an elongated carrier and secured to the latter by bonding agent and/or adhesive tape. U.S. Pat. No. 4,297,684, entitled Fiber Optic Intruder Alarm System, issued to Charles D. Butler on Oct. 27, 1981, teaches an optical fiber which is a deformable sensing element in an intruder alarm system. U.S. Pat. No. 4,234,875, entitled Security Structure, issued to William H. Williams on Nov. 18, 1980, teaches a security structure which includes an optical fiber which is utilized with a light source and a light sensor. The security structure also includes an alarm device which is electrically coupled to the light sensor.

U.S. Pat. No. 3,238,996, entitled Stretcher Frame for Oil Paintings, Ben Munn on Mar. 8, 1966, teaches a frame assembly for stretching and holding a painting canvas which includes a plurality of straight bars which are disposed in a rectangular array with each end of each bar disposed adjacent to an end of another bar to define a frame corner.

U.S. Pat. No. 4,432,150, entitled Stretcher Frame for an Artist's Canvas, issued Russel A. Swonger on Feb. 21, 1984, teaches a stretcher frame for an artist's painting canvas which include a plurality of individual frame members specifically designed to permit the outer peripheral dimensions thereof to be expanded to enlarge the dimensions of the frame and stretch the canvas.

U.S. Pat. No. 4,499,679, entitled Anti-Theft Frame Hanging System, issued to Charles F. Sherman on Feb. 19, 1985, teaches a frame body for retaining a display article and having a rear surface that can be releasably secured to a support surface. A releasable latch mechanism attaches the rear surface to the support surface and is movable between a locked position preventing removal of the frame body from the support surface and a release position allowing removal thereof. The latch mechanism comprises a release disposed between and substantially concealed by the frame body and the support surface and operable to move the latch mechanism to the release position so as to allow removal of the frame body. A plurality of spaced apart catch brackets mounts on the support surface and releasably engages the rear surface in order to be completely retained within receptacles defined thereby.

U.S. Pat. No. 3,801,055, entitled Lockable Support for Artistic Renderings on Display, issued to R. Stenger on Apr. 2, 1974 teaches a lockable support for artistic renderings on display which includes a hollow column, a floor-secured upright frame positioned centrally within the column having a lock acceptor means at its top, and a lockable top cover which accepts the base of the artistic rendering to be displayed. This lockable support protects the displayed article from theft and from falling, when the top cover with the artistic rendering is positioned on the column and locked to the frame, making unaccessible all fastener means used to secure the displayed object so long as the locking mechanism remains engaged.

SUMMARY OF THE INVENTION

In view of the foregoing factors and conditions characteristic of the prior art it is he primary object of the present invention to provide an art alarm backing for preventing either a front razor trim-out of either a painting or a tapestry or any slide-out of either its canvas or its canvas stretch frame.

It is another object of the present invention to provide an art alarm backing for limiting sabotage to one painting or tapestry.

In accordance with an embodiment of the present invention an art alarm backing for protecting a work of art is described. The art alarm backing includes a rectangular sheet of backing material which has a first surface and a second surface and a conductive wire which is mechanically coupled to the first surface of the rectangular sheet of backing material. The work of art includes a decorative frame and a stretcher frame which has a first surface and a second surface and which has a rim disposed on its first surface along its peripheral edge and a painting canvas which has a front side and a back side. The stretcher frame includes a plurality of individual frame members which permit each of four peripheral edges of the front side of the painting canvas to be folded over so that the folded over peripheral edge is adjacent to the back side of the painting canvas. The dimensions of the stretcher frame may be expanded in order to stretch the painting canvas. The stretcher frame and the painting canvas are mounted on the decorative frame. A plurality of staples secure the conductive wire to the painting canvas, the stretcher frame and the decorative frame. The second surface of the rectangular sheet of backing material is disposed adjacent to the back side of the painting canvas. The conductive wire is electrically coupled to an alarm transmitter and a tamper switch which are disposed within the decorative frame.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective drawing of a roll of a first art alarm backing which is used to protect a work of art and which has been constructed in accordance with the principles of the first embodiment of the present invention.

FIG. 2 is a partial top plan view of the first art alarm backing of FIG. 1.

FIG. 3 is a rear elevational view of a first protected work of art which includes a first decorative frame, a first stretcher frame and the back side of a first painting canvas to all of which the first art alarm backing of FIG. 1 is mechanically coupled.

FIG. 4 is an enlarged side elevational view in cross-section of the first protected work of art of FIG. 3.

DESCRIPTION OF THE PREFERRED EMBODIMENT

Figure 5:
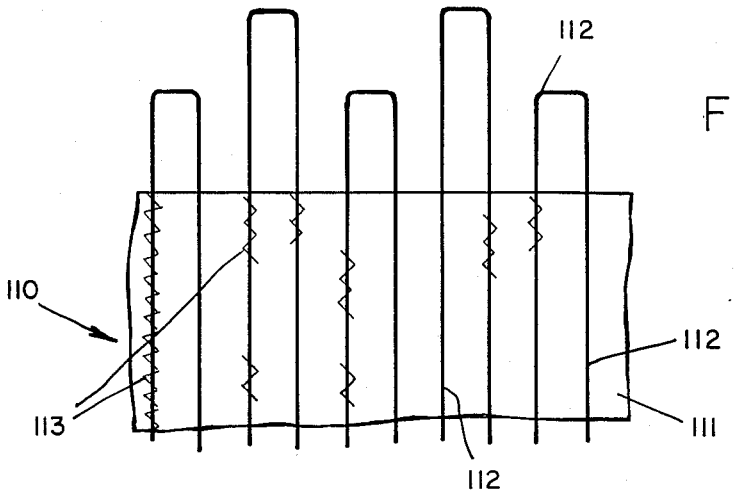
FIG. 5 is a partial top plan view of a second art alarm backing which is used to protect a work of art and which has been constructed in accordance with the principles of the second embodiment of the present invention.

In order to best understand the present invention it is necessary to refer to the following description of its preferred embodiment in conjunction with the accompanying drawing. Referring to FIG. 1 in conjunction with FIG. 2 a first art alarm backing 10 includes a strip 11 of backing material and a strand 12 of conductive wire. The strip 11 of backing material has a first surface and a second surface. The strand 12 of conductive wire is mechanically coupled to the second surface of the strip 11 of backing material. Mechanical coupling of the strand 12 of conductive wire is defined as being either sewn on with a thread 13 or glued on with a glue.

Referring to FIG. 3 in conjunction with FIG. 4, the first art alarm backing 10 is used to protect a first work of art 20 which includes a first decorative frame 21 and a first stretcher frame 22 which has a front side and a back side. The first stretcher frame 22 also has a peripheral rim 23. The first work of art 24 also includes a first painting canvas 24. The first stretcher frame 22 includes a plurality of individual frame members which are specifically designed to permit each of four peripheral edges of the front side of the first painting canvas 24 to be folded over the peripheral rim 23 in order to create a space between the front side of the first stretcher frame 22 and the back side of the first painting canvas 24 so that the front side of the first painting canvas 24 is adjacent to its back side. The outer peripheral dimensions of the first stretcher frame 22 may be expanded in order to stretch the first painting canvas 24. The first stretcher frame 21 and the first painting canvas 24 are mounted on the first decorative frame 21. A wireless transmitter and a tamper switch may be disposed within the first decorative frame 21 and electrically coupled to the strand 12 of conductive wire in order to send signals to a remote location. The strand 12 of conductive wire may also be electrically coupled to an alarm device in order to send a signal to an alarm system within the structure. A plurality of staples 25 secure the strands 12 of conductive wire to the first painting canvas 24, the stretcher frame 22 and the decorative frame 21. The backing material may be either an acid-free paper or a plastic so that the backing material does not cause any chemical damage to the first painting canvas 24. The peripheral rim 23 of the first stretcher frame 22 holds the backing material away from the first painting canvas 25 in order to further protect the first painting canvas 25.

Referring to FIG. 5 a second art alarm backing 110 includes a rectangular sheet 111 of backing material and a conductive wire 112. The rectangular sheet 111 of backing material has a first surface and a second surface. The conductive wire 112 is mechanically coupled to the second surface of the rectangular sheet 111 of backing material. Mechanical coupling of the conductive wire 112 is defined as being either sewn on with a thread 113 or glued on with a glue.

Figure 6:
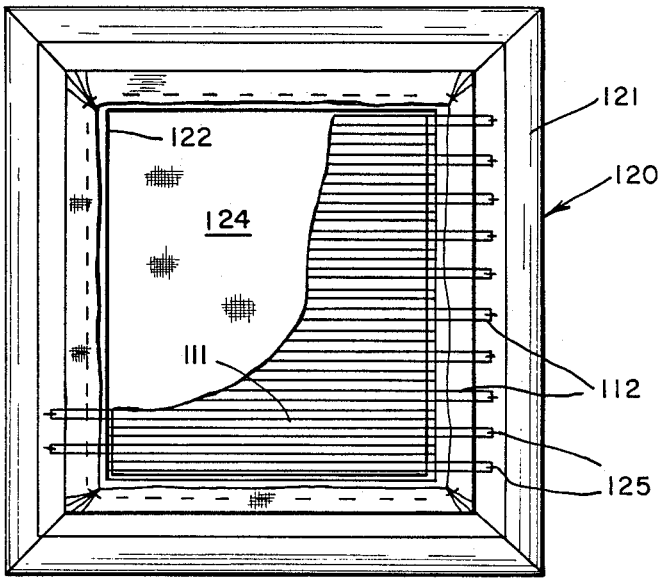
FIG. 6 is a rear elevational view of the second protected work of art which includes a second decorative frame, a second stretcher frame and the back side of a second painting canvas to all of which the second art alarm backing of FIG. 2 is mechanically coupled.
Figure 7:
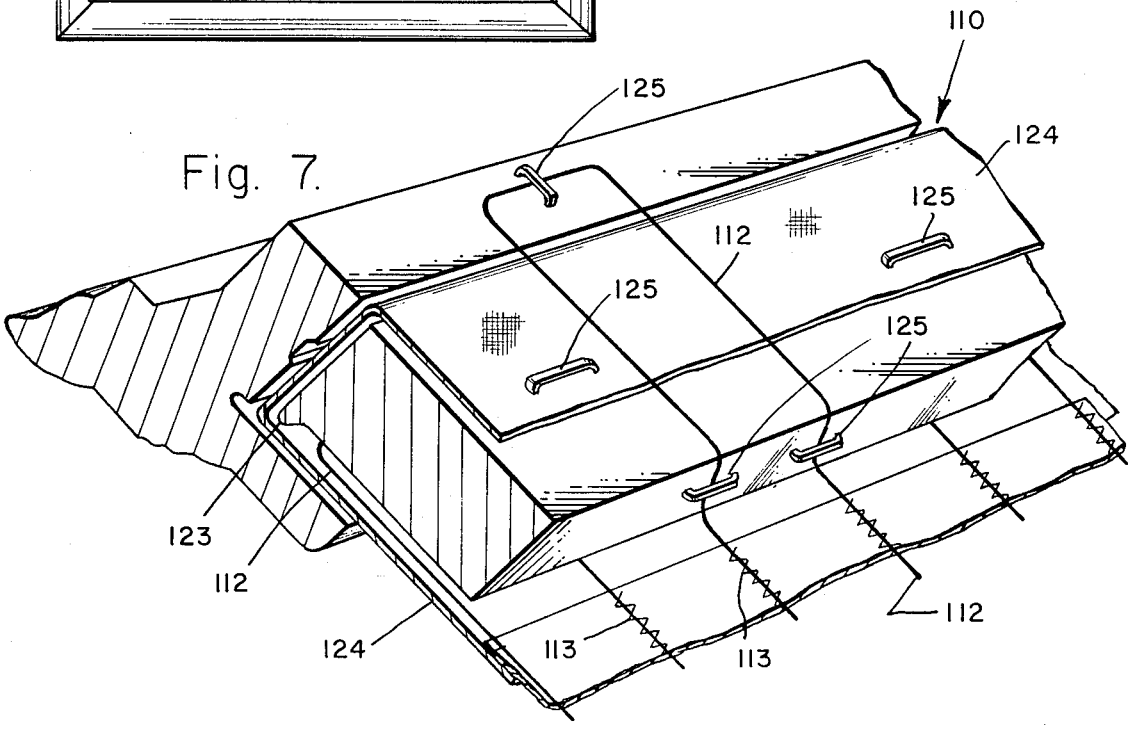
FIG. 7 is a perspective drawing in cross-section of an enlarged portion of the second protected work of art of FIG. 6.

Referring to FIG. 6 in conjunction with FIG. 7, the second art alarm backing 110 is used to protect a second work of art 120 which includes a second decorative frame 121 and a second stretcher frame 122 which has a front side and a back side and which also has a peripheral rim 123. The second work of art 124 also includes a second painting canvas 124. The second stretcher frame 122 includes a plurality of individual frame members which are specifically designed to permit each of four peripheral edges of the front side of the second painting canvas 124 to be folded over the peripheral rim 123 in order to create a space between the front side of the second stretcher frame 122 and the back side of the second painting canvas 124 so that the front side of the second painting canvas 124 is adjacent to its back side. The outer peripheral dimensions of the second stretcher frame 122 may be expanded in order to B stretch the second painting canvas 124, the second. The second stretcher frame 121 and the second painting canvas 124 are mounted on the second decorative frame 121. A wireless transmitter and a tamper switch may be disposed within the second decorative frame 121 and electrically coupled to the conductive wire 112 in order to send signals to a remote location. The conductive wire 112 may also be electrically coupled to an alarm device in order to send a signal to an alarm system within the structure. A plurality of staples 125 secure the conductive wire 112 to the second painting canvas 124, the second stretcher frame 122 and the second decorative frame 121. The backing material may be either an acid-free paper or a plastic so that the backing material does not cause any chemical damage to the first painting canvas 124. The peripheral rim 123 of the second stretcher frame 122 holds the backing material away from the second painting canvas 125 in order to further protect the second painting canvas 125.

In a third embodiment the conductive wire may be replaced by an optical fiber. U.S. Pat. No. 4,307,386 and U.S. Pat. No. 4,275,294 teach a fiber optical wave guide which is positioned against an elongated carrier and secured to the latter by a bonding agent and/or an adhesive tape. U.S. Pat. No. 4,297,684 teaches a fiber optic which is a deformable sensing element in an intruder alarm system. U.S. Pat. No. 4,234,875 teaches a security structure in which an optical fiber is utilized with a light source and a light sensor.

From the foregoing it can be seen that an art alarm backing has been described. It should be noted that the sketches are not drawn to scale and that distance of and between the figures are not to be considered significant.

Accordingly it is intended that he foregoing disclosure and showing made in the drawing shall be considered only as an illustration of the principle of the present invention.

What is claimed is:

1. An art alarm backing for use with an alarm device in order to protect a work of art which includes a painting canvas having a front side and a back side, a stretcher frame including a plurality of individual frame members which are specifically designed to permit each of four peripheral edges of the front side of the painting canvas to be folded over so that it is adjacent to the back side of the painting canvas wherein the outer peripheral dimensions of the stretcher frame may be expanded in order to stretch the painting canvas, a decorative frame on which the stretcher frame and the painting canvas are mounted, said art alarm backing comprising:

a. a strip of backing material which has a first surface and a second surface, said first surface being disposed adjacent to one of the four folded-over peripheral edges of the front side of the painting canvas;

b. a strand of conductive wire which is mechanically coupled to said second surface of said strip of backing material whereby said strand of conductive wire is electrically coupled to the alarm device; and c. securing means for securing said strand of conductive wire to the painting canvas, the stretcher frame and the decorative frame.

2. An art alarm backing for use with an alarm device in order to protect a work of art which includes a painting canvas having a front side and a back side, a stretcher frame including a plurality of individual frame members which are specifically designed to permit each of four peripheral edges of the front side of the painting canvas to be folded over so that it is adjacent to the back side of the painting canvas wherein the outer peripheral dimensions of the stretcher frame are expanded in order to enlarge the dimensions of the stretcher frame and to stretch the painting canvas, a decorative frame on which the stretcher frame and the painting canvas are mounted, said art alarm backing comprising:

a. a rectangular sheet of backing material which has a first surface and a second surface, said second surface being disposed adjacent to the back side of the painting canvas;

b. a conductive wire which is mechanically coupled to said first surface of said rectangular sheet of backing material, said conductive wire being electrically coupled to the alarm device; and c. securing means for securing said conductive wire to the painting canvas, the stretcher frame and the decorative frame.

3. An art alarm backing for use with an alarm device in order to protect a work of art, said art alarm backing comprising:

a. a rectangular sheet of backing material which has a first surface and a second surface, said second surface to be disposed adjacent to the back side of a painting canvas;

b. An optical fiber which is mechanically coupled to said first surface of said rectangular sheet of backing material, said optical fiber being optically coupled to the alarm device; and c. securing means for securing said optical fiber to the painting canvas, the stretcher frame and the decorative frame.

* * * * *